United States Patent [19]

Anthony

[11] 4,214,961

[45] Jul. 29, 1980

[54] METHOD AND APPARATUS FOR CONTINUOUS ELECTROCHEMICAL TREATMENT OF A METAL WEB

[75] Inventor: William H. Anthony, Manchester, Mo.

[73] Assignee: Swiss Aluminium Ltd., Chippis, Switzerland

[21] Appl. No.: 16,120

[22] Filed: Mar. 1, 1979

[51] Int. Cl.[2] ..... C25F 3/00; C25D 17/00

[52] U.S. Cl. ..... 204/140; 204/211; 204/129.1; 204/28

[58] Field of Search ..... 204/28, 129.1, 206, 204/211, 141.5, 144.5, 140

[56] References Cited

U.S. PATENT DOCUMENTS

| | | | |
|---|---|---|---|
| 2,494,954 | 1/1950 | Mason et al. | 204/206 |
| 2,541,275 | 2/1951 | Odier | 204/28 X |
| 3,316,160 | 4/1967 | Uchida et al. | 204/28 |
| 3,630,864 | 12/1971 | Nakamura et al. | 204/206 X |
| 3,926,767 | 12/1975 | Brendlinger et al. | 204/28 X |
| 4,014,758 | 3/1977 | Kawai et al. | 204/28 |

*Primary Examiner*—John H. Mack
*Assistant Examiner*—D. R. Valentine
*Attorney, Agent, or Firm*—Bachman and LaPointe

[57] ABSTRACT

The present invention relates to the continuous electrochemical treatment of a metal web and more particularly the continuous electrochemical graining and anodizing of aluminum metal webs for litho sheet and capacitor foil applications.

18 Claims, 5 Drawing Figures

METHOD AND APPARATUS FOR CONTINUOUS ELECTROCHEMICAL TREATMENT OF A METAL WEB

BACKGROUND OF THE INVENTION

The present invention relates to the continuous electrochemical treatment of a metal web and more particularly the continuous electrochemical graining and anodizing of aluminum metal webs for litho sheet and capacitor foil applications.

Aluminum and aluminum base alloys have been continuously electrochemically treated by a number of techniques for many years. All of these techniques require that a current be produced in the continuously moving metal web. One technique used involves introducing the current into the moving web by using a copper contact roller or bar prior to plunging the web into the treatment cell. This technique suffers from a number of disadvantages. For example, the aluminum web must be dried to avoid electrolysis which, if it occurs, dissolves the contact roller or bar anodically leaving pits in the surface thereof. An additional problem is the arcing which occurs between the two surfaces as they become separated. This arcing is brought about by the presence of edge burrs or slivers of aluminum on the web surface itself. Arcing results in pitting of the aluminum as well as pitting and oxidation of the contact member itself. A third and more important problem in the continuous electrochemical graining and anodizing of metal webs by the contact roll technique is the resulting overheating of the metal webs, anodized films and the treatment cell solution by the current carried by the web as it travels in air from the contact roller to the treatment solution. Electrochemical graining of litho sheet may require as much as 500 amps per square foot of AC or DC current at a treatment time of 30 seconds to 1 minute. If the production rate is 60 feet per minute, a 30 foot long treatment tank would be required if the treatment time is 30 seconds. If the web is 3 feet wide the current carried by the web would have to be 45,000 amps. A calculation shows that the web would heat up at the rates shown below in Table I if the current is carried by the web which travels in air from the contact roller to the solution.

TABLE I

| Gage of Web | °C. Heat Up Rate Per Second |
|---|---|
| 0.008 | 707 |
| 0.010 | 452 |
| 0.012 | 314 |
| 0.014 | 231 |
| 0.020 | 113 |

U.S. Pat. No. 3,865,700 to Fromson discloses a process and apparatus for continuously anodizing aluminum which overcomes a number of the disadvantages stated above with regard to the contact roll technique. The patent discloses a system wherein the aluminum web is first continuously anodized in an anodizing cell and thereafter enters a cathode contact cell where the current is introduced into the web as it moves through the contact cell. Thereafter, the aluminum web enters a further anodizing cell. This device reduces the surge of current in the second anodizing cell on that portion of the web which first plunges into the anodizing solution because the web already has an anodized and, therefore, electrochemically resistant film present as a result of being anodized prior to contact with the contact cell. In addition, this device avoids introducing the current into the web via a copper contact roller thus eliminating the aforenoted arcing which causes pitting on both the web and the contact roller. However, this device does not eliminate the necessity of carrying the metal web in air from the contact cell to the subsequent anodizing cell. The result, as noted previously, is an overheating of the metal web, anodizing films and treatment cell solution.

British Pat. No. 1,411,919 discloses a method and apparatus for electrochemically treating capacitor foil or litho sheet wherein the web is threaded around idler rollers in a single electrolyte cell and electricity is conveyed to the web through the treatment solution from a succession of electrodes. In accordance with this method and apparatus, the web remains immersed in the electrolyte solution while carrying the current thus avoiding overheating of the web by avoiding contact of the same with air and further by cooling the electrolyte solution. While the British patent solves the problems of overheating the web, it is faced with another disadvantage which does not exist in the more conventional approaches of carrying the current in the web from treatment cell to treatment cell as discussed above with regard to the contact roll technique in U.S. Pat. No. 3,865,700. The problem created by the British patent is the loss of electrical power which occurs by bypassing a large portion of the electrical power supplied to the electrodes through the solution paths which do not involve or contact the metal web at all.

Accordingly, it is the principal object of the present invention to provide an improved method and apparatus for continuous electrochemical treatment of a metal web.

It is a particular object of the present invention to provide an improved method and apparatus for continuous electrochemical treatment of a metal web whereby overheating of the metal web is avoided.

It is a still further object of the present invention to provide the improvements as aforesaid while maintaining an electrolyte cell designed to minimize current paths between the electrodes which bypass the web.

Further objects and advantages of the present invention will appear hereinbelow.

SUMMARY OF THE INVENTION

In accordance with the present invention, it has been found that the foregoing objects and advantages may be readily obtained.

The present invention provides an improved method and apparatus for continuous electrochemical treatment of a metal web and more particularly the continuous electrochemical graining and anodizing of aluminum metal webs for litho sheet and capacitor foil applications wherein the electrolyte cell is designed so as to eliminate overheating of the web caused by contact with air and at the same time minimize current paths between the electrodes which bypass the web. Thus, the present invention offers considerable advantages over previously known techniques by eliminating pitting on the surface of the aluminum, heat build up of the aluminum strip and loss of electrical power.

DETAILED DESCRIPTION

Figure 1:
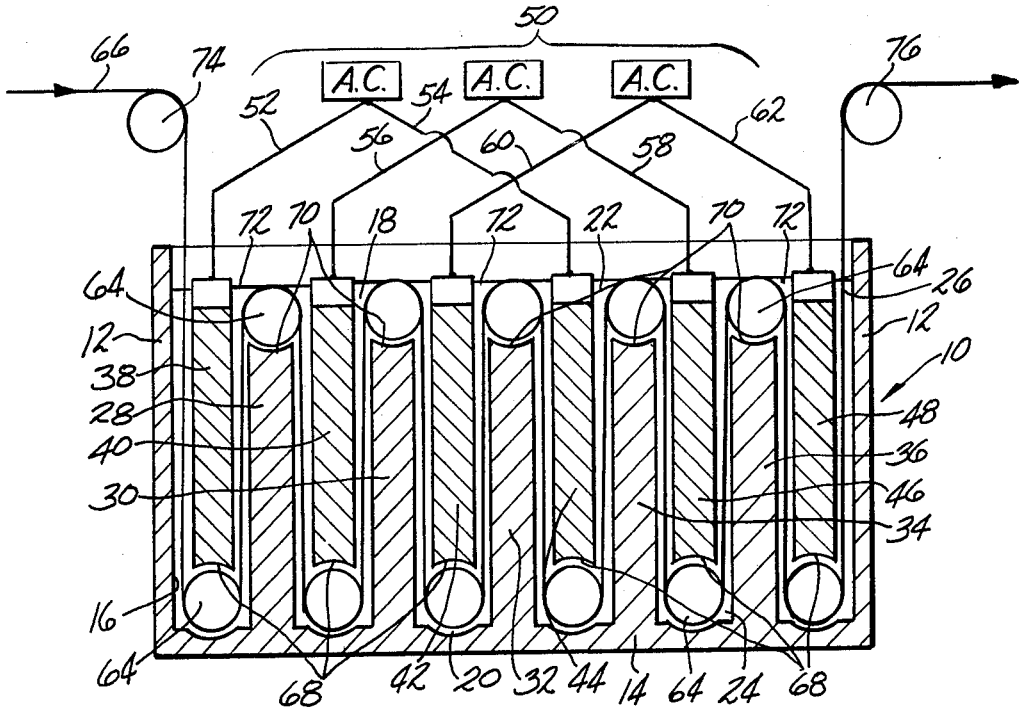
FIG. 1 is a cross sectional view of a first embodiment of an electrochemical cell in accordance with the present invention.

Referring to the figures, FIG. 1 illustrates a first embodiment of the present invention wherein a treatment cell 10 having side wall 12 and a bottom wall 14 is divided into a plurality of cells 16, 18, 20, 22, 24 and 26 by inert dividers 28, 30, 32, 34 and 36. Each of said cells 16, 18, 20, 22, 24 and 26 are provided with electrodes 38, 40, 42, 44, 46 and 48, respectively, which are connected to a three phase AC power source 50. It should be appreciated that the number of phases of AC power or the number of DC rectifiers required depends directly on the number of compartment cells employed in the treatment cell. Thus, the treatment cells illustrated in FIGS. 1-5 are divided into six compartment cells thereby requiring the use of at least three phase AC power or three DC rectifiers. If the treatment cell were divided into a two compartment cell at least one phase AC power or single DC rectifier would be required. Thus, for every two compartment cells at least a single phase AC power or a single DC rectifier would be required. Naturally, a plurality of phases of AC or a plurality of DC rectifiers could be employed for every two compartment cells if desired. The hot and ground poles, 52 and 54, respectively, of the first phase are connected to electrodes 38 and 44, respectively. Similarly, the hot and ground poles, 56 and 59 respectively, of the second phase are connected to electrodes 40 and 46, respectively. Finally, the three phase hot and ground poles, 60 and 62, respectively, are connected to electrodes 42 and 48, respectively. A plurality of idler rollers 64, one being associated with each electrode and divider, are provided in the treatment cell 10 for moving the metal web 66 through the plurality of divided cells 16, 18, 20, 22, 24 and 26. The treatment cell 10 contains an appropriate electrolyte solution 72 for anodizing or graining. The level of the solution is adjusted such that it is approximately tangential with the top surface of the idler rollers associated with the dividers. The immersed ends 68 of the electrodes and the free ends 70 of the dividers are arcuate in shape and have the same radius of curvature as the idler rollers 64. In this manner the web 66 will not travel in air as it passes over the roller and the electrolyte conductor path is restricted to the film of solution which washes over the metal which passes over the idler rollers and the solution which passes between the underside of the idler rollers and the arcuate surfaces of the dividers. As a result, the electrical resistance of the solution path between the various hot and grounded electrodes is relatively high compared to the metal web. The consequence of this is that the metal web is the chief electric current carrier between pairs of hot and grounded electrodes. Thus, electrical power loss is eliminated as well as web heat up by traveling in air overcome. The web 66 is fed to the treatment cell 10 by idler roller 74 and removed therefrom by grounded idler roller 76. The idler roller may be plastic coated steel, ceramic, or any inert nonconductive material. The electrodes are preferably made of graphite or titanium.

Figure 2:
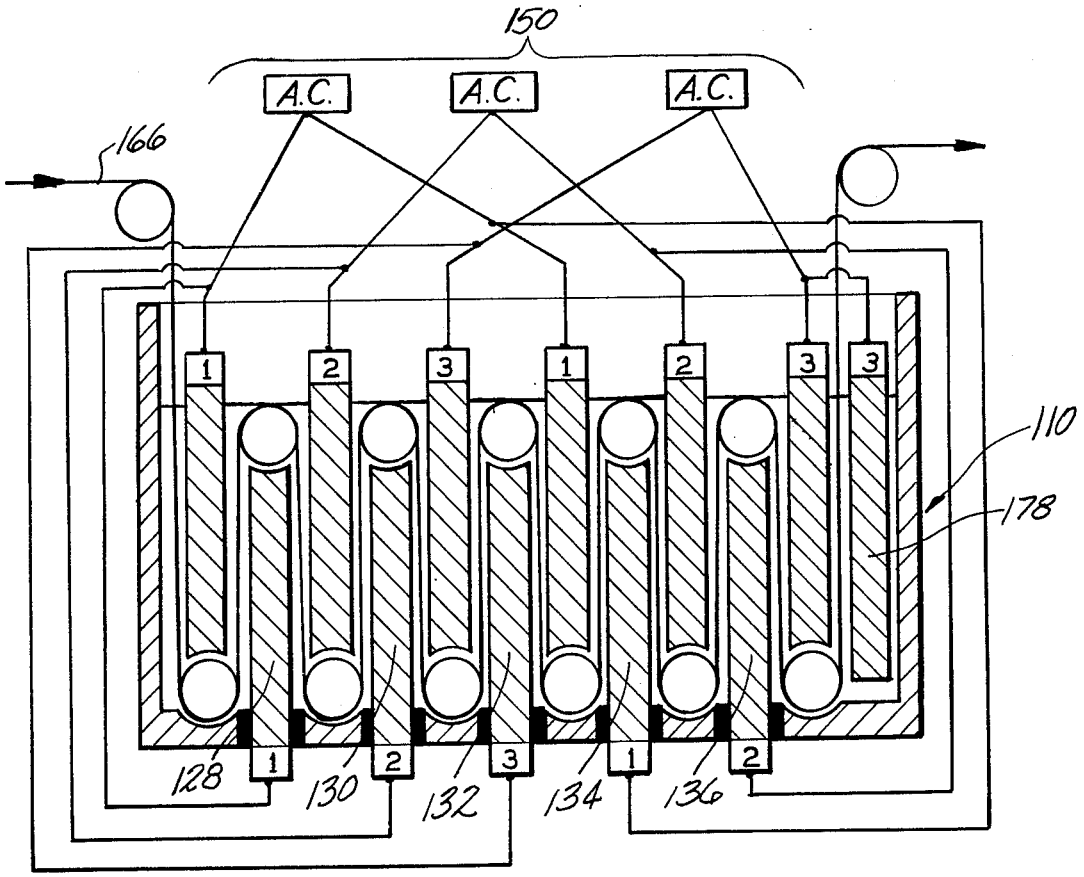
FIG. 2 is a cross sectional view of a second embodiment of an electrochemical cell in accordance with the present invention.

FIG. 2 illustrates a second embodiment of the present invention similar to that shown in FIG. 1 for applying three phase AC current 150 to electrochemically treat both sides of the metal web 166. In this treatment cell 110 the cell dividers of FIG. 1 are replaced by electrodes 128, 130, 132, 134, 136 and 178 which apply current to the opposite side of the metal web. The principle of providing an arcuate surface on these electrodes so that they can be located in close proximity to their associated idler rollers is maintained. In this manner the solution path for the current between hot and grounded electrode pairs has a high electrical resistance as discussed above with regard to FIG. 1.

Figure 3:
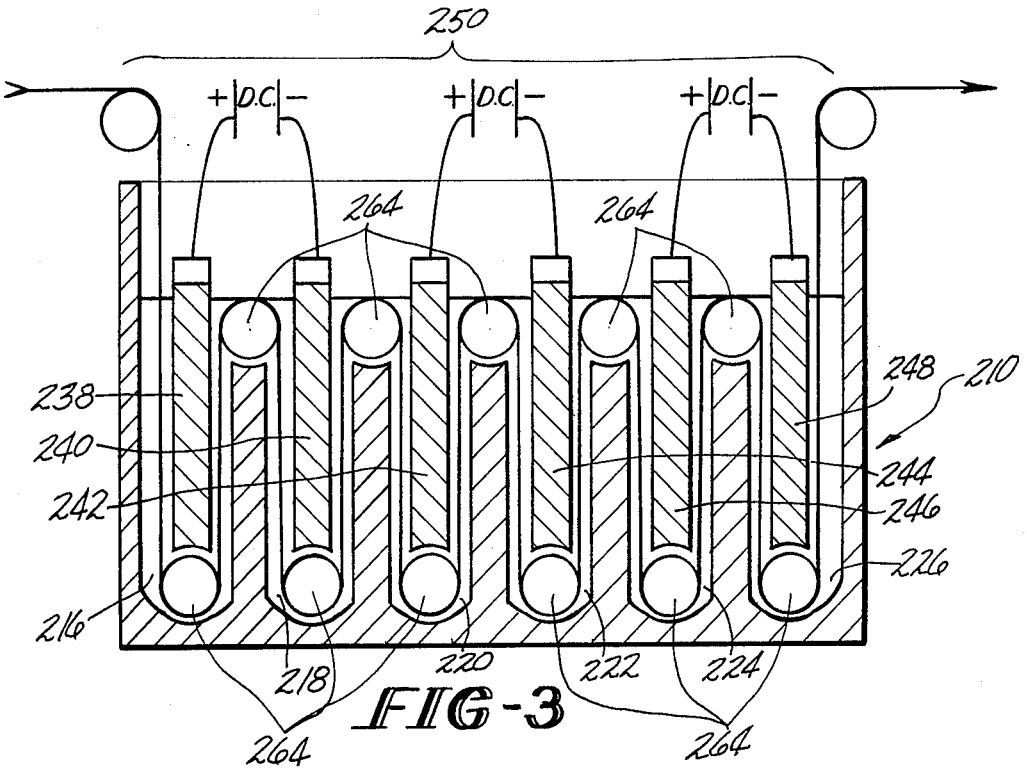
FIG. 3 is a cross sectional view of a third embodiment of an electrochemical cell in accordance with the present invention.

FIG. 3 illustrates a third embodiment of the present invention wherein a metal web is continuously treated in a treatment cell having a geometry to that disclosed with regard to FIGS. 1 and 2 wherein DC current is applied to the electrodes 238, 240, 242, 244, 246 and 248. The principle of providing an arcuate surface on these electrodes so that they can be located in close proximity to their associated idler rollers is maintained as discussed above with regard to FIGS. 1 and 2. In this manner the solution path for the current between electrode pairs has a high electrical resistance.

In the arrangement shown in FIG. 3, the metal web passes around idler rollers 264 in the same manner as previously described. Current is applied to the webs by connecting the electrodes to a set of three rectifiers 250 as shown in FIG. 1. The electrodes 238 and 240 are connected to the positive and negative poles, respectively, of a first DC rectifier. Likewise, electrodes 242 and 244 are connected to the positive and negative poles, respectively, of a second DC rectifier. Similarly, electrodes 246 and 248 are connected to the positive and negative poles, respectively, of a third DC rectifier. As a consequence of this arrangement, the metal web acts as the cathode in the first, third and fifth cell compartments 216, 220 and 224, respectively, and acts as the anode in the second, fourth and sixth cell compartments 218, 222 and 226, respectively. Electro-cleaning of the metal web therefore occurs in the first, third and fifth cell compartments and the web is anodized in the second, fourth and sixth cell compartments. The anodizing voltage may be stepped up incrementally in the successive anodizing cells, 218, 222 and 226, respectively. This particular arrangement, which offers the combination of alternate electrocleaning and incremental anodizing stages, improves the protective quality of the anodic coating compared to the coating which would be obtained if anodizing is carried out in one single stage. In addition to the foregoing, a further advantage of the arrangement of FIG. 3 is the reduction in the heat build up which would occur if anodizing to the final voltage has to be accomplished in one anodizing operation or single stage where higher current densities would have to be employed in conjunction with the higher voltages. Heat build up in anodic films during the anodizing process is well known in the continuous coil anodizing art especially when phosphoric acid is used as the electrolyte. The heat build up results in a phenomenon known as hot spotting which is where the anodic coating on the anodized surface has redissolved in local areas where there was higher than normal current between the web and the cathode. In addition to the foregoing the use of high electrical resistance electrolyte solution paths as described with regard to the embodiment of FIG. 2 has a similar benefit for the continuous coil anodizing as described with regard to the arrangement shown in FIG. 3.

Figure 4:
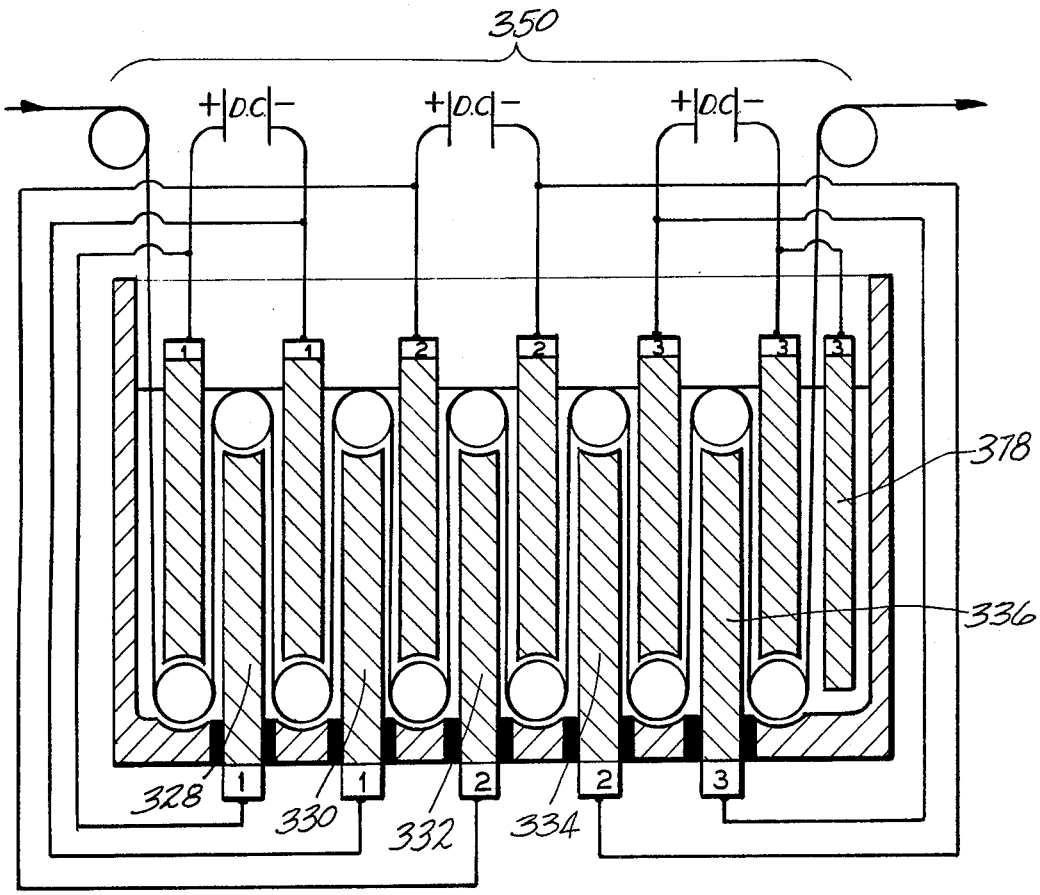
FIG. 4 is a cross sectional view of a fourth embodiment of an electrochemical cell in accordance with the present invention.

FIG. 4 illustrates a fourth embodiment of the present invention wherein continuous coil anodizing on both sides of the metal web can be accomplished by the employment of three DC rectifiers 350. As has been discussed with regard to FIG. 2, the electrodes 328, 330, 332, 334, 336 and 378 which draw current to the bottom metal web surface form the barriers between the cell compartments. Thus, the electrodes are provided with an arcuate surface so as to form with their respective associated idler rollers a restricted solution path thereby maximizing the electrical resistance between the adjacent cells.

Figure 5:
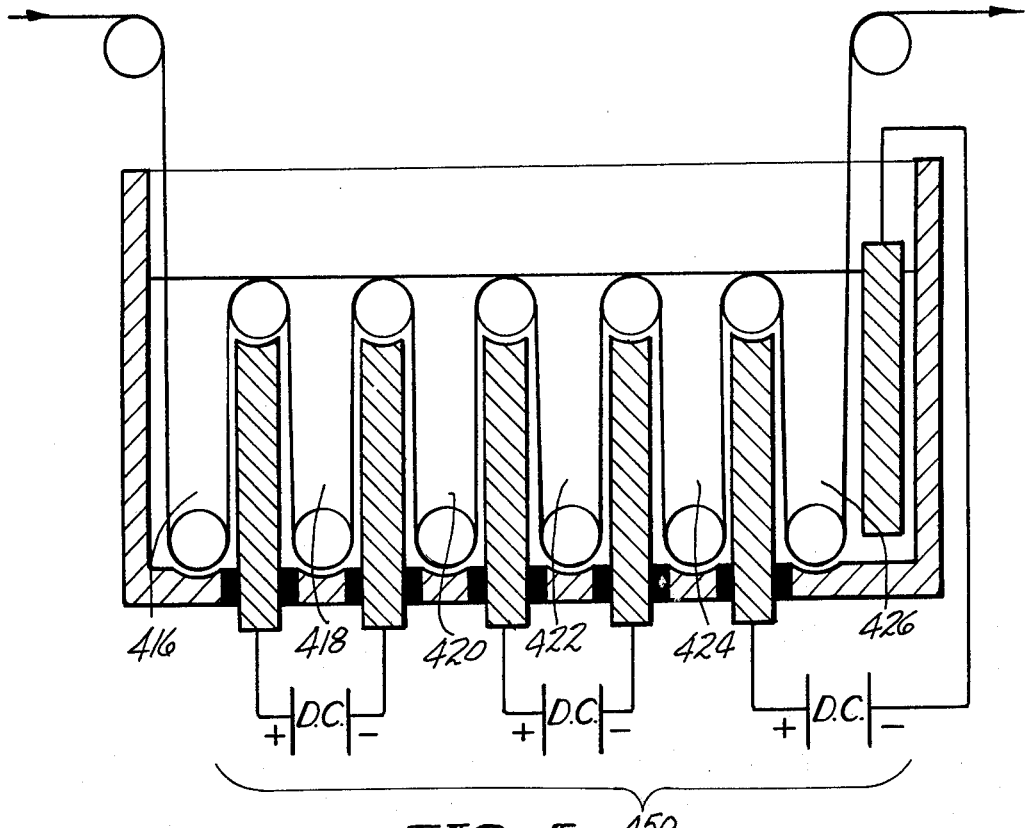
FIG. 5 is a cross sectional view of a fifth embodiment of an electrochemical cell in accordance with the present invention.

FIG. 5 illustrates a fifth embodiment of the present invention wherein a metal web may be electrochemically grained on one side and anodized on the other side. Thus, in the arrangement shown in FIG. 5 cells 416, 420 and 424 act as cathodic graining compartments while cells 418, 422 and 426 act as anodizing compartments. Current is applied to the webs through a set of three rectifiers 450 in the manner shown in FIG. 5 and in the same manner as previously discussed in FIGS. 3 and 4. As is the case with the treatment cells of the embodiments of FIGS. 1–4 the design of the treatment cell of FIG. 5 incorporates the idea of maximizing the electrical resistance between the adjacent cell compartments by providing an arcuate shaped surface for increasing the resistance of the solution path between adjacent cells.

The level of the solution in all the treatment cells shown in FIGS. 1–5 is adjacent such that it is approximately tangential with the top surface of the idler rollers associated with the respective arcuate surfaces on the dividers or electrodes which form the cell compartments. In this manner the metal web will not travel in air as it passes over the rollers from one cell to an adjacent cell. In addition, the electrolyte conductor path is restricted to the film of solution which washes over the metal which passes over the idler rollers and the solution which passes between the underside of the idler rollers and the arcuate surface of the dividers or electrodes. The consequence of this construction is that the metal web is the chief electric current carrier between the electrodes thus minimizing electrical power loss.

The present invention provides an improved method and apparatus for continuous electrochemical treatment of a metal web and more particularly the continuous electrochemical graining and anodizing of aluminum metal webs for litho sheet and capacitor foil applications wherein the electrolyte cell is designed so as to eliminate overheating of the web caused by contact with air and at the same time minimize current paths between the electrodes which bypass the web. Thus, the present invention offers considerable advantages over previously known techniques by eliminating pitting on the surface of the aluminum, heat build up of the aluminum strip and loss of electrical power.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for the continuous electrochemical treatment of a metal web wherein said web is the chief current carrier and current paths between neighboring treatment cells are minimized, comprising the steps of:

(A) providing an electrochemical treatment cell;

(B) dividing said electrochemical treatment cell into a plurality of treatment cells by divider means comprising a first plurality of electrodes positioned in said treatment cell;

(C) filling said treatment cells with an electrolyte solution to a height substantially equal to the height of said divider means;

(D) providing a second plurality of electrodes in the electrolyte solution;

(E) passing current to said first and said second plurality of electrodes; and (F) guiding said web through said plurality of treatment cells such that said web is continuously immersed in said electrolyte wherein said web is the chief current carrier and the electrolyte conductor path between said treatment cells is restricted by said divider means thereby minimizing electrical power loss.

2. A method according to claim 1 wherein at least one electrode is provided in each of said plurality of cells.

3. A method according to claim 2 wherein said divider means comprises a divider having a free end and web guiding means proximate to said free end for restricting the conductor path between said treatment cells wherein the height of said electrolyte is substantially equal to the height of the top of said guiding means.

4. A method according to claim 1 further comprising web guiding means proximate to said electrodes.

5. A method according to claim 2 wherein an AC power source is provided for passing current to said electrodes.

6. A method according to claim 2 wherein a DC power source is provided for passing current to said electrodes.

7. A method according to claim 1 wherein an AC power source is provided for passing current to said electrodes.

8. A method according to claim 1 wherein a DC power source is provided for passing current to said electrodes.

9. A method according to claim 4 wherein a DC power source is provided for passing current to said electrodes.

10. An apparatus for the continuous electrochemical treatment of a metal web wherein said web is the chief current carrier and current paths between neighboring treatment cells are minimized comprising:

(A) a treatment cell;

(B) divider means comprising a first plurality of electrodes positioned in said treatment cell for separating said treatment cell into a plurality of treatment compartments;

(C) means for maintaining an electrolyte solution in said treatment compartments to a height substantially equal to the height of said divider means;

(D) a second plurality of electrodes positioned in said electrolyte solution;

(E) a power source connected to said first and said second plurality of electrodes; and (F) means for feeding said web through said plurality of treatment compartments while maintaining said web immersed in said electrolyte solution so as to prevent overheating of said web wherein said web is the chief current carrier and said divider means restricts current paths between said plurality of treatment compartments.

11. An apparatus according to claim 10 wherein each of said plurality of treatment compartments is provided with an electrode.

12. An apparatus according to claim 11 wherein said divider means comprises a divider having a free end and a web guiding means proximate with said free end of said divider for restricting the conductor path between said treatment cells.

13. An apparatus according to claim 12 wherein said divider is made of inert material.

14. An apparatus according to claim 10 wherein said power source is an AC power source.

15. An apparatus according to claim 10 wherein said power source is a DC power source.

16. An apparatus according to claim 12 wherein said power source is an AC power source.

17. An apparatus according to claim 12 wherein said power source is a DC power source.

18. An apparatus for the continuous electrochemical treatment of a metal web wherein said web is the chief current carrier and current paths between neighboring treatment cells are minimized comprising:

(A) a treatment cell;

(B) divider means comprising a divider and a web guiding means positioned in said treatment cell for separating said treatment cell into a plurality of treatment compartments wherein the free end of said divider is arcuate in shape and has a first radius of curvature;

(C) means for maintaining an electrolyte solution in said treatment compartments to a height substantially equal to the height of said divider means;

(D) a second plurality of electrodes positioned in said electrolyte solution;

(E) a power source connected to said first and said second plurality of electrodes; and (F) web guiding means for feeding said web through said plurality of treatment compartments while maintaining said web immersed in said electrolyte solution so as to prevent overheating of said web, said web guiding means comprises a roller having a second radius of curvature equal to said first radius of curvature of said divider wherein said web is the chief current carrier and said divider means restricts current paths between said plurality of treatment compartments.

* * * * *

UNITED STATES PATENT AND TRADEMARK OFFICE

CERTIFICATE OF CORRECTION

PATENT NO. : 4,214,961

DATED : July 29, 1980

INVENTOR(S) : William H. Anthony

It is certified that error appears in the above—identified patent and that said Letters Patent is hereby corrected as shown below:

Column 7, line 18, claim 14, "10" should read -- 11 --.

Column 7, line 20, claim 15, "10" should read -- 11 --.

Column 7, lines 22 and 24, "12", each occurrence, should read -- 10 --.

Signed and Sealed this

*Thirteenth* Day of *January 1981*

[SEAL]

*Attest:*

*Attesting Officer*

SIDNEY A. DIAMOND

*Commissioner of Patents and Trademarks*